United States Patent [19]

Schroeder

[11] Patent Number: 4,802,413

[45] Date of Patent: Feb. 7, 1989

[54] PRINTING PLATE SECURING

[75] Inventor: Richard B. Schroeder, Wilmington, Del.

[73] Assignee: Hercules Incorporated, Wilmington, Del.

[21] Appl. No.: 65,951

[22] Filed: Jun. 24, 1987

[30] Foreign Application Priority Data

Jul. 11, 1986 [GB] United Kingdom ..... 8616952

[51] Int. Cl.[4] ..... B41F 1/30; B41F 13/08

[52] U.S. Cl. ..... 101/415.1; 101/409

[58] Field of Search ..... 101/415.1, 409

[56] References Cited

U.S. PATENT DOCUMENTS

| | | | |
|---|---|---|---|
| 809,288 | 1/1906 | Dick | 101/415.1 |
| 1,739,585 | 12/1929 | Fleming | 101/415.1 |
| 1,858,305 | 5/1932 | Meisel | 101/415.1 |
| 2,209,127 | 7/1940 | Lowe | 101/415.1 |
| 2,963,969 | 12/1960 | Sauberlich | 101/415.1 |
| 3,095,811 | 7/1963 | Peabody | 101/415.1 |
| 3,603,255 | 9/1971 | Horner | 101/415.1 |
| 3,824,928 | 7/1974 | Langer | 101/415.1 |
| 4,214,530 | 7/1980 | Signorelli | 101/415.1 |

FOREIGN PATENT DOCUMENTS

| | | | |
|---|---|---|---|
| 640262 | 12/1936 | Fed. Rep. of Germany | 101/415.1 |
| 526837 | 3/1939 | United Kingdom | 101/415.1 |

*Primary Examiner*—Clyde I. Coughenour
*Attorney, Agent, or Firm*—Connolly & Hutz

[57] ABSTRACT

A rotary printing press includes a printing plate mounted around a plate cylinder. The printing plate is in the form of a pair of semi-cylindrical resilient substrates. Each substrate is mounted to the printing plate by forming a multiple bend on the non-printing area of the leading edge of each substrate and mechanically locking the multiple bend to the printing plate.

20 Claims, 3 Drawing Sheets

PRINTING PLATE SECURING

BACKGROUND OF THE INVENTION

This invention relates to printing plates and is particularly concerned with a type of printing plate which has a flexible or resilient backing sheet or substrate below the printing surface.

Such printing plates are normally formed in two semi-cylindrical parts which together, when placed upon the printing cylinder, form the complete printing plate surface.

It is of course essential to attach the printing plates to the plate cylinder securely and this invention is particularly concerned with the attachment features of printing plates.

SUMMARY OF INVENTION

An object of the invention is to provide a simple but effective form of attachment which requires no additional parts and which can be formed from the substrate of the printing plate.

According to the present invention a printing plate substrate comprises a retaining feature formed at the leading end of the substrate, the retaining feature consisting of at least a first bend to bring a portion of the leading end of the substrate back under the substrate (below the printing surface) and a second bend to set the extreme leading edge of the substrate at an acute angle to the first bend portion.

Preferably the angle between the extreme leading edge and the first bent portion is such that the extreme leading edge is substantially reversed as compared with the first bent portion so that it extends generally in the original direction of the leading end.

The substrate is preferably of a resilient material and this resilient material assists in enabling the retaining feature to lock the leading end of the substrate either into a slot in a plate cylinder or into a conventional torsion cylinder plate lock such as a Barenschee universal torsion cylinder plate lock.

There may be more than two bends in the leading edge so as to create a zig-zag, saw tooth, square, or other configuration which will provide greater tension and more effective locking.

The bends may be formed in the leading end and extend right across the substrate of each half of the printing plate. Alternatively the leading end of each half of the printing plate could be formed with teeth and each of the teeth could have the bends formed in it, there being at least a double bend in each tooth.

From another aspect the invention relates to a printing plate substrate in combination with a torsion cylinder plate lock, the torsion cylinder plate lock having a recess to receive the leading end of the printing plate substrate and having a locking step in the recess so arranged that when the leading end of the substrate, formed with a multiple bend, is inserted into the recess the bent leading end will spring open so that the leading end engages and holds against the locking step to prevent the leading end of the printing plate being pulled out of the cylinder plate lock.

The trailing edge of each half of the plate may be held in the cylinder plate lock by spring tension and does not require the double bend.

The invention is particularly applicable to rotary printing presses of the type used for printing newspapers and has particular application to a newspaper type printing plate.

The substrate may be of any semi-rigid material such as plastic type film, fiberglass sheet, paper base or thin metal. Such materials have a natural resilience which assist the spring lever or wedging action of the leading edge of the plate into the mechanical lock of the torsion cylinder plate lock.

Photopolymer tabs can be located on the bends to aid in the plate installation and/or strengthen the holding grip of the multiple bend.

The multiple bends in the leading edge of the printing plate can be bent in mirror image so that the step or ramp in the plate cylinder recess can be located on either side of the mechanical lock if desired.

THE DRAWINGS

Figures 2, 2A:
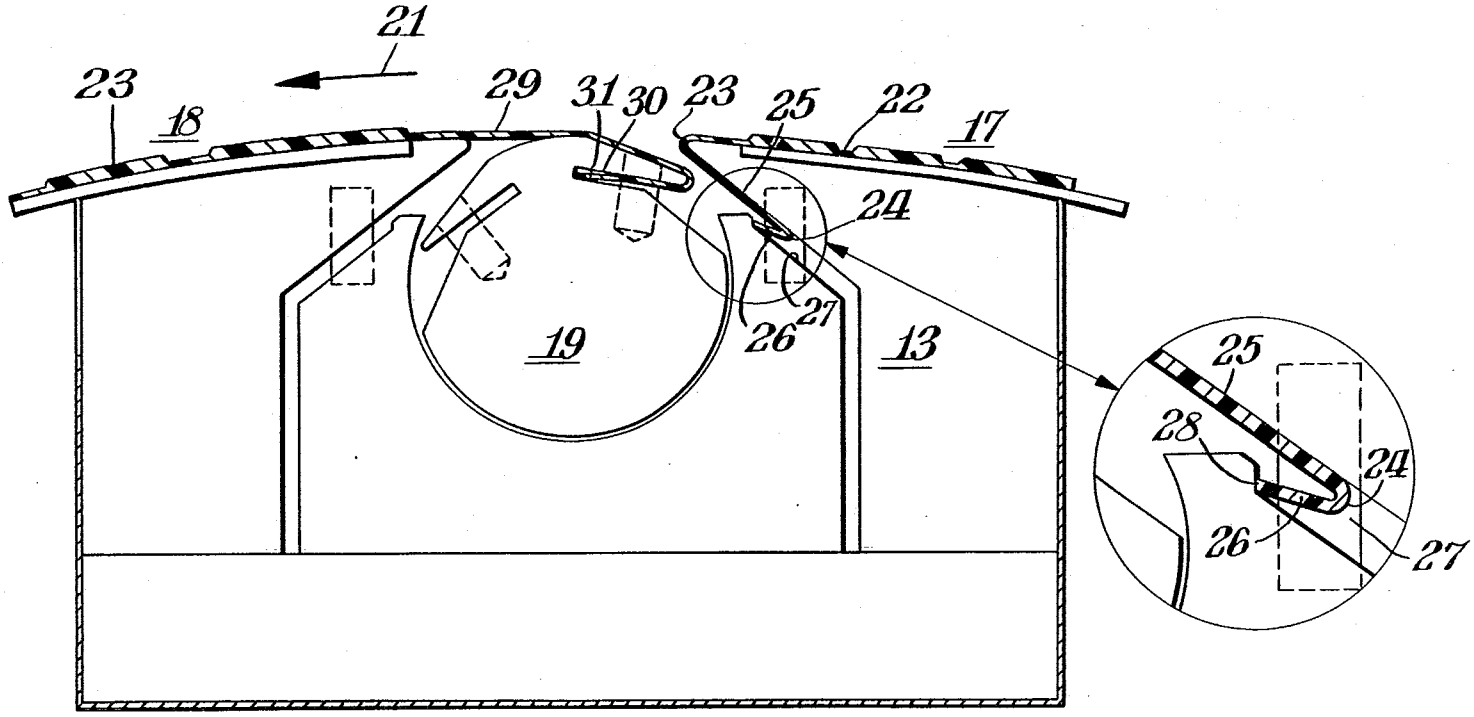
FIG. 2 is an enlarged end elevation of part of a plate cylinder shown in FIG. 1.
Figure 4:
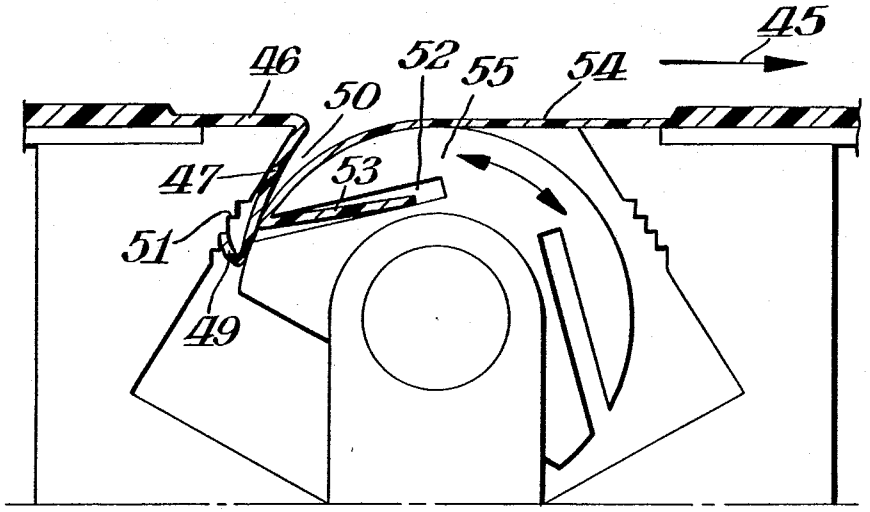

FIG. 2*a* is an enlarged elevation of a portion of FIG. 2;

FIGS. 3*a*–3*g* show variations of bends applied to the backing sheet or substrate of a printing plate in accordance with the invention;

FIG. 4 shows an alternative embodiment of the invention; and

Figure 5:
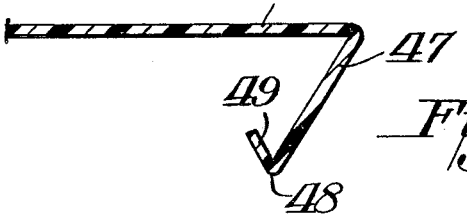

FIG. 5 is an enlarged elevation of a portion of the bent substrate shown in FIG. 4.

DETAILED DESCRIPTION

Figure 1:
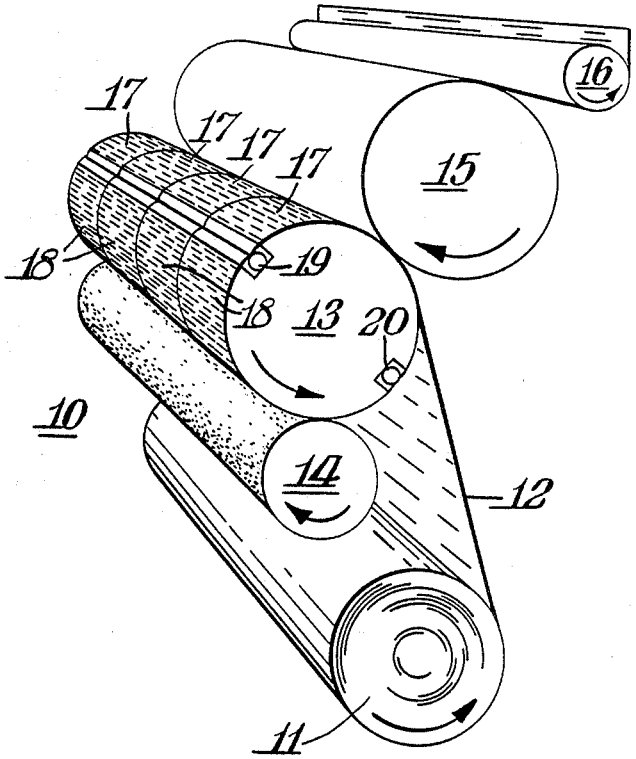
FIG. 1 is a diagrammatic perspective view of the essential parts for a rotary printing press to which the present invention may be applied.

The rotary printing press 10 shown in FIG. 1 has the conventional paper roll 11 carrying paper 12 which is to be printed on a plate cylinder 13 fed with ink by an ink cylinder 14. The usual impression cylinder 15 and backing roll 16 are also shown. On the plate cylinder there are four sets of printing plates. Each printing plate is in two semi-cylindrical portions 17 and 18 and these semi-cylindrical portions of the printing plate are held on the plate cylinder 13 by torsion cylinder plate locks 19 and 20.

The direction of rotation of the various cylinders is indicated by arrows on the ends of the cylinders.

In FIG. 2 the way in which the printing plate halves 17 and 18 are secured to the plate locks 19 and 20 is shown in more detail. One of the plate locks 19 is shown together with parts of the surrounding structure. The plate cylinder 13 is set to rotate in the direction of the arrow 21 in FIG. 2. The leading end of printing plate half 17 is illustrated and the trailing end of printing plate half 18. Each printing plate half comprises a substrate, respectively 22 and 23, of a resilient, flexible, plastic material. As shown in FIG. 2, the leading end of substrate 17 is formed with a first bend 23 and a second bend 24. The first bend 23 brings the portion 25 of the substrate back underneath the printing plate and the second bend 24 brings the portion 26 of the substrate, right at the leading edge, back in the original direction of the substrate.

As can be seen in FIG. 2, the leading end of the substrate 22 is engaged in a slot or recess 27 in the cylinder 13. As seen in FIG. 2*a* the slot or recess has a shoulder 28 adapted to form a lock. When the leading end of the substrate is put into the slot 27 the portion 24 will tend to be compressed against the portion 25 as the leading end enters the slot 27. Once the leading end has passed the shoulder 28 the portion 26 will resiliently deflect so that its extreme end will engage the locking shoulder 28 thus preventing the leading edge from pulling out of the recess.

The trailing edge of substrate 29 of printing plate half 18 is formed as shown in FIG. 2 with two bends which in effect produce a hook-like portion 30 engageable in a slot 31 in the plate lock 19.

The hook-like portion 30 is held in position by the tension in the substrate created by the torsion cylinder of plate lock 19 and does not require locking in the same way.

Figure 3:
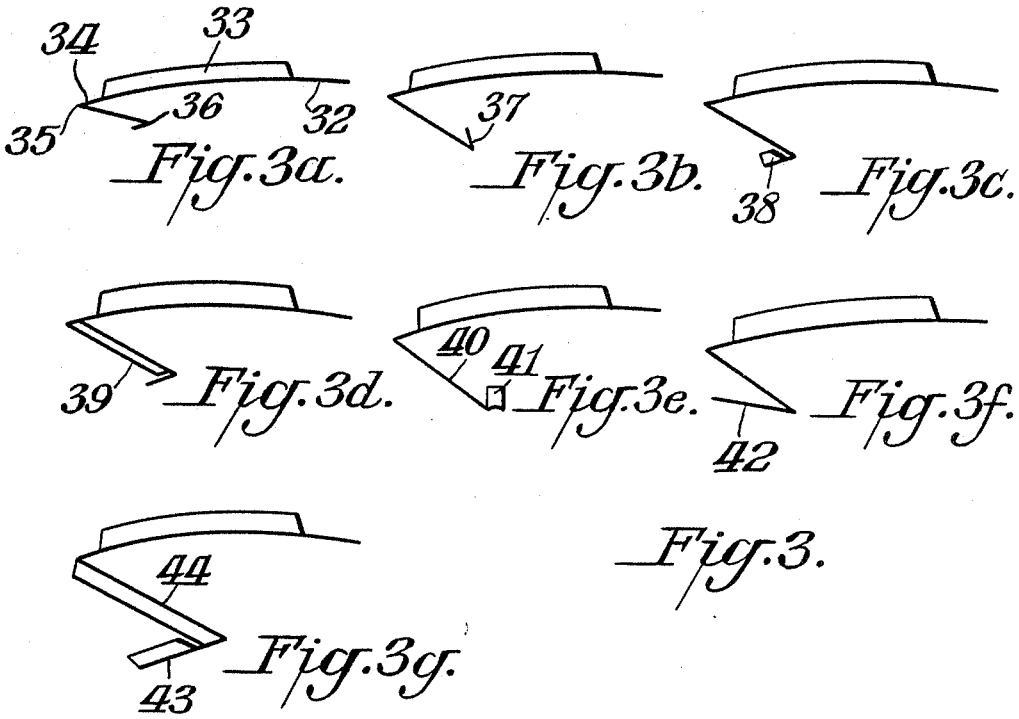

A number of variations are shown in FIG. 3 of the way in which the multiple bend is formed in the leading edge of the substrate. In FIG. 3*a* is shown a substrate 32 with a printing portion 33 and the leading edge 34 has two bends 35 and 36 in the form of a Z so as to form the leading edge as shown in the example in FIG. 2.

In FIG. 3*b* the extreme leading edge is bent at 37 in the opposite direction to that shown in FIG. 3*a*. In FIG. 3*c* the leading edge includes a photopolymer build-up 38 to provide reinforcement and increase the strength and stiffness of the extreme leading edge. In FIG. 3*d* the leading edge has a build-up on the first bent portion 39. In FIG. 3*e* the initial bent portion 40 has no build-up, but extreme end 41 has a build-up. FIG. 3*f* is similar to FIG. 3*a* but has an extended portion 42 at the extreme leading end. FIG. 3*g* shows a build-up on both bent portions 43, 44. It is noted that in each modification having a build-up, the build-up is located on the same surface as the printing portion 33 (i.e. if there were no bends the build up bars would be on the same outer surface as printing portion 33).

In FIG. 4 is shown a modification in which the plate cylinder 13 rotates in the direction of the arrow 45 and the leading edge 46 of a plate substrate is bent as shown in FIG. 5 with the initial bend producing a portion 47 which is then bent again at 48 to produce a second portion 49 in an inwardly reversed direction.

The portion 47 is engaged in a slot 50 which has serrated teeth 51 so that the portion 49 will engage the teeth and hold the locking feature of this substrate firmly in position. The plate lock itself has a rotatable part 55 with a slot 52 in which the trailing edge 53 of the substrate 54 is engaged. It will be seen that this rotatable part 55 helps to fold the portion 47 of the leading edge in position so that the portion 49 engages the teeth 51.

The substrate of the printing plate may also have cut-out notches located on both ends which fit over registration pins for side to side register in the conventional way.

The way in which the trailing end of the plate is held in is conventional.

The way in which the leading edge retaining feature acts is similar to the action of an umbrella being opened in a closet. Once it is opened the umbrella cannot be pulled out of the closet. This umbrella action concept of the invention may be practiced in numerous ways. Thus any number of bends may be used including a Z, zig-zag or saw tooth. The bend angles need not be sharp but could be subtle bends or undulations as long as the leading end does not follow a straight path. Similarly the extreme end portion could be at any angle to the first bent portion and can extend in any direction.

Though illustrated in relation to printing plates for use in typical rotary printing presses used for producing newspapers, clearly the invention is applicable to any printing plate where it is necessary to lock the leading edge of the printing plate into a rotary printing press plate cylinder and the invention may be applied to any printing plate which has a substrate or backing member which is flexible or resilient.

What is claimed is:

1. In a printing plate assembly of a rotary printing press wherein a printing plate is mounted to a plate cylinder and wherein the printing plate includes at least one pair of semi-cylindrical substrates mounted around the periphery of the plate cylinder, the improvement being in said substrates being made of resilient, flexible non-metallic material, locking means for securing said substrates to said plate cylinder, said locking means including the leading end in the non-printing area of at least one of said substrates being formed in a multiple bend, said multiple bend forming a first bent portion being in the reverse direction to said one substrate and below the printing surface of said one substrate, said multiple bend further forming a second bent portion being at an angle to said first bent portion and below said printing surface of said one substrate, said assembly including a narrow elongated recess which is non-radial with respect to the axis of said plate cylinder, said recess being below said printing surface and being exposed at said leading end, a shoulder at the mouth of said recess defining a narrow passageway with said recess being wider beyond said shoulder, said multiple bend in its uncompressed condition being wider than the width of said recess, said multiple bend being inserted into said recess in a compressed condition and engaged against the walls of said recess, and the free end of said multiple bend being against the same wall as said shoulder at a steep angle thereto and disposed beyond and in contact with said shoulder whereby said multiple bend springs open beyond said shoulder and said shoulder prevents said multiple bend from being inadvertently removed from said recess.

2. The assembly of claim 1 wherein the leading end of each of said substrates includes said locking means.

3. The assembly of claim 1 wherein sets of pairs of said substrates are mounted on said plate cylinder along the length of said plate cylinder.

4. The assembly of claim 1 wherein said one substrate is made of a plastic material.

5. The assembly of claim 1 wherein said first bend portion is integral with and adjacent to said printing surface and said second bent portion being at the extreme leading edge of said one substrate in a direction generally reverse to said one substrate to form an acute angle between said bent portion whereby said multiple bend is a Z.

6. The assembly of claim 1 wherein said multiple bend forms a zig-zag pattern.

7. The assembly of claim 1 wherein said multiple bend extends across the substrates where said substrates are secured to said cylinder plate.

8. The assembly of claim 1 wherein said leading end of said one substrate is formed with teeth, and each of said teeth having at least one multiple bend.

9. The assembly of claim 1 wherein serrated teeth are formed in said recess for engagement with said leading end.

10. The assembly of claim 1 wherein the trailing end of said one substrate is secured to said plate cylinder by spring means.

11. The assembly of claim 10 wherein said trailing end terminates in an inwardly extending hook-like bent portion engaged in a slot in a torsion cylinder secured to said plate cylinder.

12. The assembly of claim 1 including a build-up bar on at least one of said bent portions.

13. The assembly of claim 12 wherein said build-up bar is on the same side of its bent portion as the printing surface.

14. The assembly of claim 12 wherein said build-up bar is a photopolymer build-up.

15. The assembly of claim 1 including a build-up bar on each of said bent portions.

16. The assembly of claim 1 wherein said first bent portion is integral with and adjacent to and below said printing surface, and said multiple bend being in the form of a non-straight path terminating in the extreme leading edge which also is below said printing surface.

17. The assembly of claim 16 wherein said extreme leading edge comprises said second bent portion.

18. The assembly of claim 16 wherein said extreme leading edge is at an acute angle to said one bent portion.

19. The assembly of claim 18 wherein said extreme leading edge extends in a direction generally reverse to said first substrate.

20. The assembly of claim 18 wherein said extreme leading edge extends in generally the same direction as said one substrate.

* * * * *

UNITED STATES PATENT AND TRADEMARK OFFICE

CERTIFICATE OF CORRECTION

PATENT NO. : 4,802,413

DATED : February 7, 1989

INVENTOR(S) : Richard B. Schroeder

It is certified that error appears in the above-identified patent and that said Letters Patent is hereby corrected as shown below:

Column 6, line 6 of Claim 18;

"one" should --first-- .

Signed and Sealed this

First Day of August, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,802,413

DATED : February 7, 1989

INVENTOR(S) : Richard B. Schroeder

It is certified that error appears in the above-identified patent and that said Letters Patent is hereby corrected as shown below:

Column 6, line 10, "first" should read --one--.

Signed and Sealed this

Tenth Day of October, 1989

*Attest:*

DONALD J. QUIGG

*Attesting Officer*

*Commissioner of Patents and Trademarks*